US008074835B2

(12) United States Patent
MacMichael et al.

(10) Patent No.: US 8,074,835 B2
(45) Date of Patent: Dec. 13, 2011

(54) DISPENSING SMALL QUANTITIES OF PARTICLES

(75) Inventors: Bruce MacMichael, Cambridge (GB); Will Opie, Bonn (GB); Simon Bryant, Hertfordshire (GB)

(73) Assignee: Capsugel Belgium BVBA (BE)

( * ) Notice: Subject to any disclaimer, the term of this patent is extended or adjusted under 35 U.S.C. 154(b) by 906 days.

(21) Appl. No.: 11/571,169

(22) PCT Filed: Jun. 28, 2005

(86) PCT No.: PCT/GB2005/002523

§ 371 (c)(1),
(2), (4) Date: Sep. 18, 2007

(87) PCT Pub. No.: WO2006/003379

PCT Pub. Date: Jan. 12, 2006

(65) Prior Publication Data

US 2008/0017669 A1 Jan. 24, 2008

(30) Foreign Application Priority Data

Jul. 1, 2004 (GB) ..... 0414811.0

(51) Int. Cl.
*G01F 11/00* (2006.01)
*B65D 88/66* (2006.01)

(52) U.S. Cl. ..... 222/1; 222/161; 222/189.02; 222/196; 366/110

(58) Field of Classification Search ..... 222/161, 222/164, 167, 168, 181.1, 189.02, 196, 197, 222/200, 1; 366/110, 114
See application file for complete search history.

(56) References Cited

U.S. PATENT DOCUMENTS

| | | | | | |
|---|---|---|---|---|---|
| 31,409 | A | * | 2/1861 | Saunders | 222/161 |
| 767,591 | A | * | 8/1904 | Nickerson | 222/196 |
| 2,246,497 | A | * | 6/1941 | Beck | 222/161 |
| 3,791,558 | A | * | 2/1974 | Katusha | 222/161 |
| 4,260,108 | A | * | 4/1981 | Maedgen, Jr. | 239/171 |

FOREIGN PATENT DOCUMENTS

| | | |
|---|---|---|
| GB | 2100235 | 12/1982 |
| GB | 2120215 | 11/1983 |
| GB | 2123802 | 2/1984 |
| JP | 234501 | 8/2002 |
| WO | 99/19215 | 4/1999 |
| WO | WO01/33176 | 5/2001 |
| WO | WO03/026965 | 4/2003 |

OTHER PUBLICATIONS

WO 1999/19215 is the English equivalent of New Zealand Patent NZ503153 published May 31, 2002.
Search Report from GB 0217790.5.

* cited by examiner

*Primary Examiner* — Kevin P Shaver
*Assistant Examiner* — Daniel R Shearer
(74) *Attorney, Agent, or Firm* — Finnegan, Henderson, Farabow, Garrett & Dunner, L.L.P.

(57) ABSTRACT

An apparatus for dispensing small quantities of particles, the apparatus comprising a hopper (20) provided with a sieve at a bottom portion thereof, the hopper defining a powder-containing zone above the sieve which in use contains powder to be dispensed therefrom through the sieve, a support (25) for the hopper, the support holding a portion of the hopper so that the hopper can in use be held above a container into which the dispensed powder is to be received, at least one actuator (30) for delivering impact energy to the hopper for causing powder to be dispensed through the sieve when the hopper receives the impact energy, and an element which is adapted to permit controlled vertical movement of the hopper relative to the support.

22 Claims, 4 Drawing Sheets

DISPENSING SMALL QUANTITIES OF PARTICLES

The present invention relates to an apparatus and method for dispensing small quantities of particles.

WO-A-01/33176 discloses an apparatus and method for dispensing small quantities of particles, in particular small amounts of medicament especially in a powder form. The apparatus uses dispense head comprising a funnel shaped hopper with a plurality of holes in a membrane at the base of the hopper, forming a sieve-like element, through which powder present in the hopper may fall. A preferred method is to tap the hopper horizontally to cause such a movement, thereby controllably dispensing powder through the membrane. The tapping is achieved by an electro-mechanical actuator which delivers impact energy to the hopper, which in turn causes a small number of particles to fall through the sieve-like element and onto a weighing measuring balance. The actuator is a horizontally oriented solenoid which taps the side of the hopper via a rod which supports the hopper at one end and has the solenoid mounted at the other end. A tapping action can also be done with a vertical component to the action of the actuator or the resultant movement of the hopper.

FIG. 1 shows schematically the dispensing head of a precision powder metering system as described in WO-A-01/33176.

Referring to FIG. 1, the device consists of a powder dispense head comprising a hopper 1 for a powder material, for example a medicament used for administration to the lungs of a patient via a powder inhaler or a medicament to be filled into a gelatin capsule which can be eaten by a patient. The hopper 1 is of generally frusto-conical form with the larger end 2 open and uppermost. The smaller end 3 is closed by a plate 4 in which a plurality of holes 5 are formed, thereby forming a sieve. When a powder 7 is placed in the hopper 1, some powder 7 may initially fall through the holes 5 but thereafter, in general, the powder flow stops as the powder 7 jams in the holes 5. The flow of powder 7 through the holes 5 can be made controllable and reproducible by the choice of appropriate dimensions for the holes to match the properties of the powder. Typically, the holes lie in the range of from 100 microns to 2000 microns.

In order to use the apparatus for precision dispensing, a receptacle 8 for the powder 7 is placed under the plate 4 and the hopper 1 is tapped on the sidewall 9 thereof at a location 6. The tap may be in a form that results from the impact of a mass travelling at a controlled velocity, for example from the end of an electromechanical tapping actuator, such as a solenoid. The resulting motion of the hopper 1 and powder 7 causes the powder 7 to flow through the holes 5 in the plate 4 for a small period of time following the impact, after which the powder flow stops. Thus a discrete amount of powder 7 is controllably dispensed into the receptacle 8 as a result of each tap.

In order to accurately dispense a desired total amount of the powder 7, a plurality of taps are used to fill each receptacle 8 and the total weight of powder 7 dispensed into the receptacle 8 is measured in real time so that as soon as the required amount has been dispensed, the tapping can be stopped. The rate of tapping is controlled by a control computer. If desired, a mechanical action on the dispense head other than tapping may be employed controllably to dispense the powder.

It is disclosed that the hopper is usually clamped to a rod which carries the electro-mechanical tapping actuator so as to ensure that the hopper cannot move relative to the rod. However, another arrangement is disclosed in which the hopper is not clamped and merely sits in an aperture in the rod so as to be able to be perturbed vertically and/or rotationally. It is stated that it is thought that the actuator provides a horizontal force which is converted in part to a vertical force at the hopper side walls, possibly due to the tapered nature of these side walls, and that the rotations are thought to be due to asymmetries in the components, for example when the plane of the aperture in the rod in which the hopper sits is not precisely horizontal. It is disclosed that the vertical motion serves to fluidise the powder particles, making them easier to dispense, and that the rotational motion can help the particles from being compressed or otherwise stuck together.

The known dispense head described hereinabove relies for its effectiveness on its ability to dispense roughly consistent amounts of powder with each successive mechanical action or tap. This occurs because a roughly similar amount of drug powder is released through the holes on each occasion, as the bridge of powder over any given hole is broken. In a typical application the powder may consist of particles which are 20 to 100 microns diameter, and the holes may be 300 or 400 microns diameter.

This known system works very well with the majority of materials. However it has some shortcomings when loaded with materials which have a tendency to agglomerate. Sometimes drug materials can be ground or milled down to very small particle size, to help with drug dissolution and absorption within the patient, or for other purposes. When the small particles are of the order of a few microns in diameter, the powder is typically described in the art as being 'micronised'. These materials frequently have a tendency to form large loose agglomerates when handled. These agglomerates take the form of larger assemblies of particles formed from loosely grouped individual particles, rather like snowballs made from powdered snow. These larger particles may be many different sizes—commonly ranging from tens of microns in diameter up to 2 or 3 millimeters in diameter, or even larger.

It will be appreciated that with a powder which has a tendency to agglomerate, the holes may become occluded by agglomerated assemblies of particles whose diameters are greater than the hole diameters. Although some smaller particles may be released, the amount can be very small, and thus the process of dispensing may take considerably longer as a consequence and in some circumstances render the process of dispensing by the dispense head unachievable.

Attempts to remedy this by employing a dispense head which has larger holes are only of limited success, because the agglomerates are not of consistent size. The result of this is that the amount of drug released from the dispense head for any given tap or mechanical action becomes very variable. If the agglomerates become larger, then the flow is restricted again. If the agglomerates are locally smaller, then too large amounts of powder can be released, leading to potential over dispensing above the target value, and the process is more difficult to control.

The disclosure in WO-A-01/33176 concerning the provision of an unclamped hopper which is free to some extent to move vertically and/or rotationally in an aperture does not provide controlled and repeatedly achievable effects on the powder during dispensing so as to be able to ensure avoidance of agglomeration of the powder particles.

The present invention at least partially aims to overcome these problems of the known apparatus and method for dispensing small quantities of particles using a dispense head.

Accordingly, the present invention provides an apparatus for dispensing small quantities of particles, the apparatus comprising a hopper provided with a sieve at a bottom portion thereof, the hopper defining a powder-containing zone above the sieve which in use contains powder to be dispensed therefrom through the sieve, a support for the hopper, the support holding a portion of the hopper so that the hopper can in use be held above a container into which the dispensed powder is to be received, at least one actuator for delivering impact energy to the hopper for causing powder to be dispensed through the sieve when the hopper receives the impact energy, and an element which is adapted to permit controlled vertical movement of the hopper relative to the support.

In one preferred aspect, the element comprises a clamp for clamping the hopper to the support, the clamp being configured to permit the hopper to move vertically in the clamped configuration over a particular distance.

The apparatus may further comprise a biasing device between the hopper and the support for biasing the hopper to a first position of the clamped configuration, the hopper being movable towards a second position of the clamped configuration against the bias of the biasing device.

Preferably, the biasing device comprises a compression spring.

The compression spring may be disposed between two parts of the clamp and urges the hopper downwardly.

In another embodiment, the element comprises a stop member, spaced above a holder for the hopper, to define a height by which the holder can move vertically.

The apparatus may further comprise a height adjustment mechanism for adjusting the height of the stop member.

In another preferred aspect, the support comprises an annular portion having an aperture within which the hopper is received, the upper surface of the annular portion has a stepped ratchet configuration adapted additionally to create controlled rotational movement of the hopper, and a holder for the hopper rests on the stepped ratchet configuration.

Preferably, the stepped ratchet configuration comprises a succession of abutting inclined step portions extending peripherally around the upper surface of the annular portion.

Preferably, the step portions are separated by radially directed edges.

Preferably, the holder is provided with a plurality of downwardly depending members which rest on the ratchet surface.

The present invention also provides a method of dispensing small quantities of particles, the method comprising the steps of: disposing in a hopper provided with a sieve at a bottom portion thereof a powder to be dispensed therefrom through the sieve; supporting the hopper by holding a portion of the hopper with a support so that the hopper is held above a container into which the dispensed powder is to be received, and providing an element which is adapted to permit controlled vertical movement of the hopper relative to the support; and delivering impact energy to the hopper by at least one actuator thereby to cause powder to be dispensed through the sieve when the hopper receives the impact energy and to permit controlled vertical movement of the hopper relative to the support.

In one preferred aspect, the element comprises a clamp for clamping the hopper to the support, the clamp being configured to permit the hopper to move vertically in the clamped configuration over a particular distance.

Preferably, a biasing device is disposed between the hopper and the support for biasing the hopper to a first position of the clamped configuration, the hopper being movable towards a second position of the clamped configuration against the bias of the biasing device.

Preferably, the biasing device comprises a compression spring.

The compression spring may urge the hopper downwardly.

In another embodiment, the element comprises a stop member, spaced above a holder for the hopper, to define a height by which the holder can move vertically.

Preferably, the height of the stop member is adjustable.

In another preferred aspect, the element is adapted additionally to create controlled rotational movement of the hopper relative to the support.

Preferably, the support comprises an annular portion having an aperture within which the hopper is received, the upper surface of the annular portion has a stepped ratchet configuration adapted to create rotational movement of the hopper, and a holder for the hopper rests on the stepped ratchet configuration.

Preferably, the stepped ratchet configuration comprises a succession of abutting inclined step portions extending peripherally around the upper surface of the annular portion.

Preferably, the step portions are separated by radially directed edges.

Preferably, the holder is provided with a plurality of downwardly depending members which rest on the ratchet surface.

Preferably, rotational movement of the hopper causes a change in the at least one of the angle and direction of tilt of the hopper.

This invention accordingly provides the advantage that the powder in the hopper is subjected to a deagglomeration action as a result of controlled vertical, and optionally additional rotational movement, and possibly tilting, of the hopper during powder dispensing, which tends to form a more homogeneous distribution of particle sizes, as a result of the deagglomeration action tending to reduce particle agglomeration in the hopper by physical breaking up of any agglomerates and/or by preventing any further agglomerates from being formed. This in turn tends to permit more accurate dispensing of the target weights of the powder, with in particular less incidence of over dispensing above the target dispensed weight, and also tends to provide more even dispensing times for successive doses of the same target weight.

The present invention is predicated on the discovery by the inventors that the agglomeration problem can reliably and repeatably be reduced or substantially eliminated by mechanically treating the powder immediately prior to dispensing while the powder is in the hopper, by controllably moving the hopper vertically and optionally additionally rotationally, and/or by tilting the hopper, in the aperture.

Embodiments of the present invention will now be described by way of example only with reference to the accompanying drawings, in which.

Figure 7:
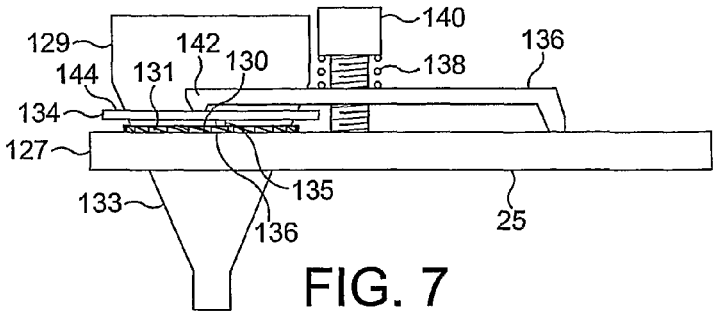
FIG. 7 is a schematic side view of the arm of FIG. 5 when supporting a hopper which is incorporated in the powder dispensing apparatus in accordance with the third embodiment of the present invention.
Figure 8:
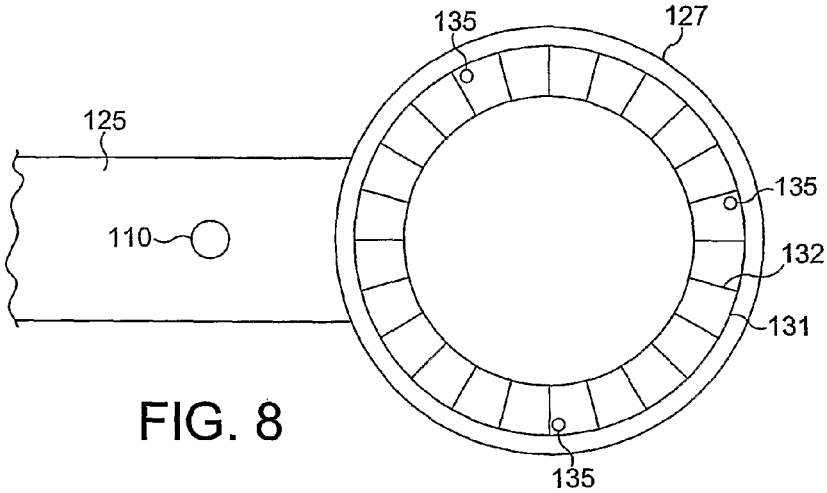
Figure 9:
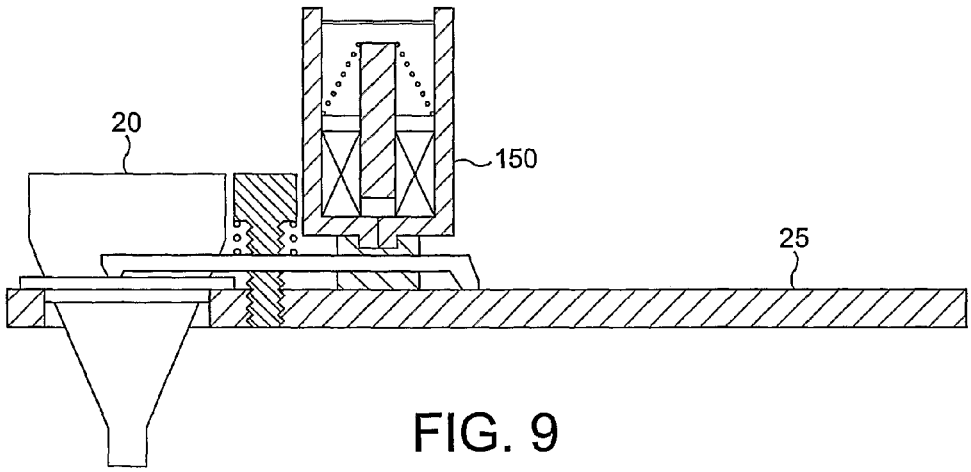

FIG. 8 is a schematic plan view of the arm of FIG. 7 showing the contact points between the supporting pawls on the ring for the hopper and the plurality of inclined faces on the upper surface of the supporting ring of the arm; and FIG. 9 is a schematic section, from one side through a hopper and a tapping device in accordance with a further embodiment of the present invention for dispensing powder into a receptacle.

Figure 1:
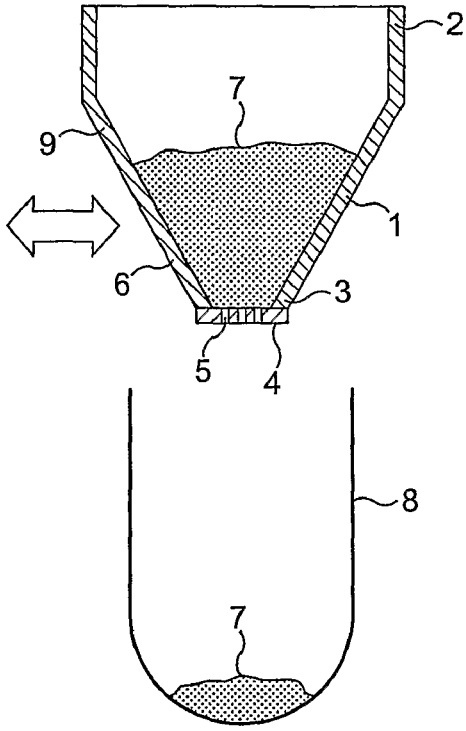
FIG. 1 is a schematic section, from one side, through a hopper of a known powder dispensing apparatus for dispensing powder into a receptacle.
Figure 2:
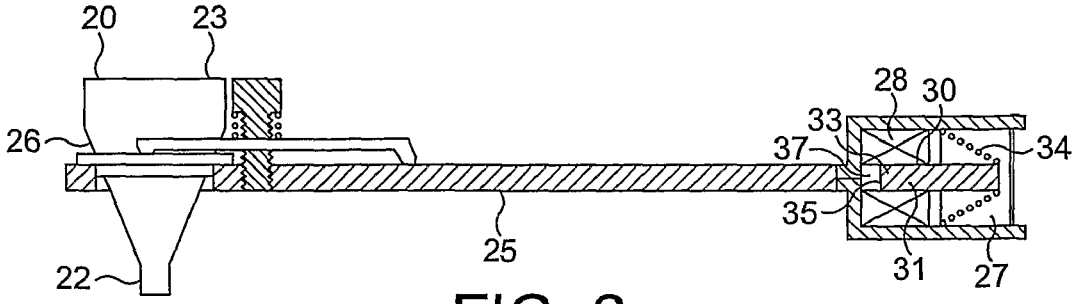
FIG. 2 is a schematic section, from one side, through a hopper, and a tapping device of a powder dispensing apparatus in accordance with the present invention for dispensing powder into a receptacle.

FIG. 2 shows a hopper and a tapping device of a powder dispensing apparatus in accordance with the present invention for dispensing powder into a receptacle. In this embodiment, a frusto-conical hopper 20 has a sieve (not shown), in the form of a horizontally oriented plate with a plurality of sieving holes therethrough, at its smaller lower end 22 and a larger upper end 23 for receiving bulk powder, such as medicament, to be dispensed through the sieve. The hopper 20 is supported by a cantilever arm 25, which is attached to or bears against a sidewall 26 of the hopper 20. Within the cantilever arm 25 is provided a longitudinally directed cavity 27, and in the cavity 27 is disposeda longitudinally oriented solenoid coil 28 of a solenoid 30, comprising an electro-mechanical actuator. The coil 28 is rigidly attached to the cantilever arm 25. An armature 31 of the solenoid 30 comprises a longitudinally extended body having a projecting portion 33, extending within the coil 28. A helical spring 34 is provided, to bias the armature 31 so as to be partly located in the coil 28. The projecting portion 33 has an end wall 35 spaced from a respective end face 37 of the cavity 27 in the rest position as a result of the bias from the spring 34.

When a current pulse is passed through the coil 28, the armature 31 is accelerated towards the end face 37 of the cavity 27 and the end wall 35 impacts it. The impact momentum is transferred by the cantilever arm 25 to the hopper 20 and the bulk powder therein and causes a discrete amount of the powder to fall into a receptacle (not shown) located, in use, beneath the sieve of the hopper 20. Thereafter, when the current pulse is terminated the spring 34 urges the armature 31 back to the rest position.

With this arrangement it is possible to tap the hopper 20 along the cantilever arm 25. Accordingly, powder dispensing occurs by successive tapping steps corresponding to successive powder dispense actions.

The use of a solenoid 30 to generate the impact on the hopper 20 and the bulk powder therein allows the magnitude of the impact to be altered by controlling the voltage driving the coil 28 of the solenoid 30. The same effect can be achieved by changing the pulse width, i.e. the period of time during which the coil 28 is switched on.

The problem of agglomeration of the bulk powder in the hopper 20 above the sieve 21 is overcome in accordance with the invention by the provision of a support for the hopper 20 which is permits controlled vertical, and optionally additional rotational, movement of the hopper 20, and optionally also causes the axis of the hopper 20 to tilt about an angle relative to the vertical. These structures can assist in either preventing the formation of agglomerates and/or breaking up any agglomerates which have formed. A number of different embodiments of the hopper support structures are described below.

Figure 3:
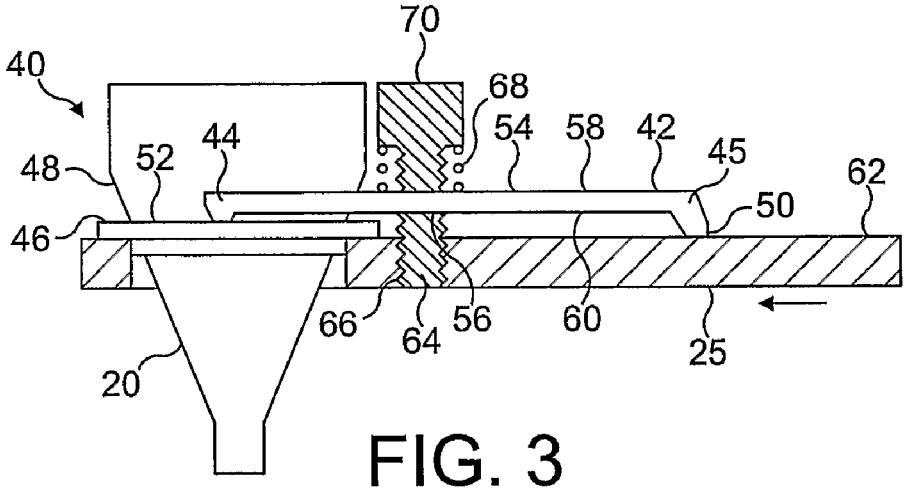
FIG. 3 is an enlarged schematic section, from one side, of the hopper of FIG. 2 showing the clamping arrangement for the hopper in accordance with a first embodiment of the present invention.

Referring to FIG. 3, there is shown a first embodiment of a hopper support structure, designated generally as 40, by which the hopper 20 is mounted on the cantilever arm 25. The hopper support structure 40 comprises a clamp member 42 having an end part 44 which engages a peripheral ring 46 affixed to the hopper 20 around the outer wall 48 of the hopper 20. The end part 44 bears downwardly on an upper surface 52 of the ring 46. The end part 44 may extend wholly or partly around the periphery of the hopper 20. The clamp member 42 also has a body part 54 having a central hole 56 extending downwardly therethrough, an upper surface 58 and a lower surface 60. An opposite end part 45 of the clamp member 42 bears against the upper surface 62 of the cantilever arm 25 at a fulcrum part 50. A threaded bolt 64 extends downwardly through the hole 56 and the end thereof is received in a threaded bore 66 in the cantilever arm 25. A helical compression spring 68 is disposed about the bolt 64 between the head 70 of the bolt 64 and the upper surface 58 of the clamp member 42. The helical compression spring 68 thereby applies a controlled downwardly directed bias onto the hopper 20 via the engagement of the end part 44 and the ring 46. The threaded bolt 64 may be threadably adjusted so as to alter the degree of the downwardly directed bias on the hopper 20. The bolt 64 may be provided with incremental axial positions whereby the vertical position of the bolt 64, and thereby the degree of bias and the total distance that the hopper 20 is able to move vertically, can be altered incrementally, for example over a total distance of 2 mm in 0.25 mm increments. This provides an indexed control over the bias on the hopper 20, and also on the maximum distance that the hopper 20 is able to be moved vertically in the cantilever arm 25.

Figure 4:
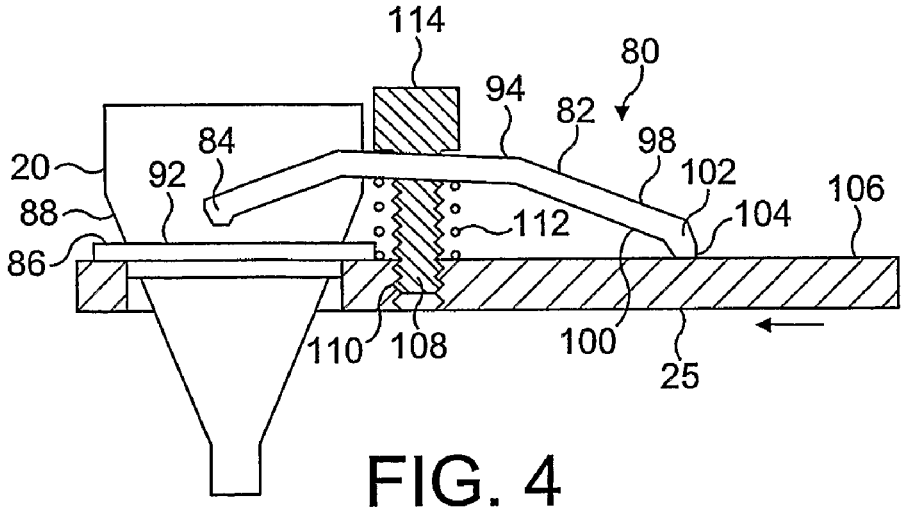
FIG. 4 is an enlarged schematic section, from one side, of the hopper of FIG. 2 showing the clamping arrangement for the hopper in accordance with a second embodiment of the present invention; the clamp constituting a stop member to define a limit of vertical movement of the hopper.
Figure 5:
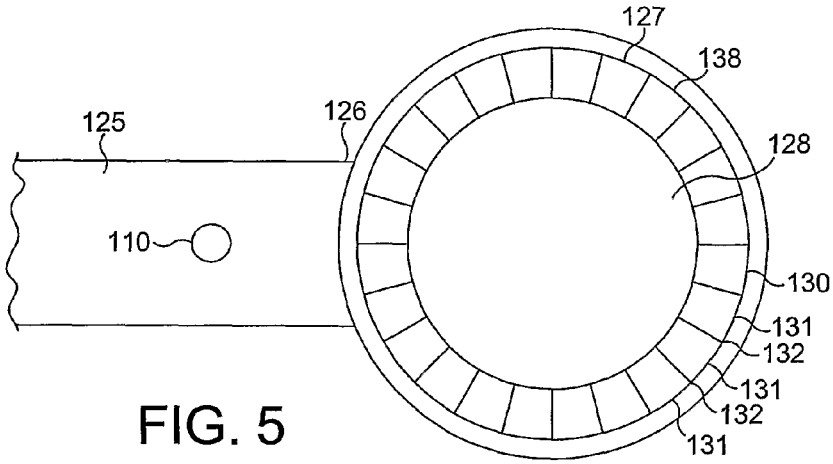
FIG. 5 is a schematic plan view of an arm for supporting a hopper which is incorporated in a powder dispensing apparatus in accordance with a third embodiment of the present invention.
Figure 6:
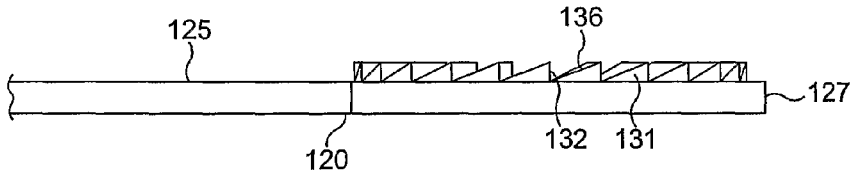
FIG. 6 is a schematic side view of the arm of FIG. 5.

Referring to FIG. 4, there is shown a second embodiment of the present invention, incorporating a hopper support structure, designated generally as 80, for mounting the hopper 20 on the cantilever arm 25. The hopper support structure 80 comprises a clamp member 82 having an end part 84 which can bear against a peripheral ring 86 affixed to the hopper 20 around the outer wall 88 of the hopper 20. The end part 84 extends around the periphery of the ring 86 and can bear downwardly on an upper surface 92 of the ring 86. The clamp member 82 also has a body part 94 having a central hole 96 extending downwardly therethrough, an upper surface 98 and a lower surface 100. A second opposite end 102 of the clamp member 82 has a fulcrum part 104 extending downwardly therefrom which bears against the upper surface 106 of the cantilever arm 25. A threaded bolt 108 extends downwardly through the hole 96 and the end thereof is received in a threaded bore 110 in the cantilever arm 25. The head 114 of the bolt 110 engages the upper surface 98 of the clamp member 82 and a helical compression spring 112 is disposed about the bolt 110 between the upper surface 106 of the cantilever arm 25 and the lower surface 98 of the clamp member 82. The helical compression spring 112 thereby applies a controlled upwardly directed bias onto the clamp member 82. The threaded bolt 110 may be threadably adjusted so as to alter the angle of inclination, about the fulcrum part 104, of the clamp member 82 and thereby the vertical position of the end part 84 of the clamp member 82. The bolt 110 may be provided with incremental axial positions whereby the vertical position of the bolt 110, and thereby the vertical position of the end part 84 of the clamp member 82, can be altered incrementally. As shown in FIG. 4, the hopper is disposed, in use, in an unclamped position where the end part 84 is remote from and above the peripheral ring 86, thereby acting as a stop member defining a height range over which the hopper can jump when impacted. The vertical component of any, movement of the hopper relative to the support is thereby limited in a controller manner.

For each of the embodiments of FIG. 3 and FIG. 4, when the hopper 20 is subjected to the tapping action as shown by the arrows in FIGS. 3 and 4, the tapping action causes the hopper 20 to be moved not only horizontally, but also vertically, as a result of the hopper 20 receiving impact energy from the actuator. For the embodiment of FIG. 3, the amount of upward vertical displacement caused by the impact is controlled by the amount of the biasing force applied by the helical spring. For both embodiments the maximum vertical displacement is controlled by the longitudinal position of the bolt, which in turn controls the vertical position of the end part of the clamping member.

Referring to FIGS. 5 to 8, there is shown a further embodiment of the present invention. In this embodiment, as shown in particular in FIGS. 5 and 6, the cantilever arm 125 is provided at its free end 126 with an annular portion 127 having a central aperture 128 within which the hopper 129 is movably received. The upper surface 130 of the annular portion 127 has a succession of abutting inclined step portions 131 extending peripherally therearound. The step portions 131 are separated by radially directed edges 132. The upper surface 132 of each step portion 131 is inclined to the horizontal and all the step portions 131 are inclined in the same direction. Accordingly, the upper surface 130 of the annular portion 127 is formed as a circumferential ratchet surface 130. The step height at each ratchet step edge may be from 0.2 to 1 mm.

Turning to FIGS. 7 and 8, the hopper 129 is provided on its inclined outer surface 133 with an annular ring member 134 which is attached thereto, at a vertical height above the centre of gravity of the hopper 129 and ring member 134, and extends circumferentially outwardly from the hopper 129. The ring member 134 is provided with a plurality of downwardly depending pawl members 135. Each pawl member 135 has a lower end 136 which rests on the ratchet surface 130 of the annular portion 127. The number of and angular relationship between the pawl members 135 are selected, in conjunction with the dimensions and angular relationship of the step portions 131, so that in any rotational position of the hopper 129, the pawl members 135 engage with different vertical features as they rest on respective step portions 131 of the ratchet surface 130. This causes the hopper 129 to rotate about a vertical axis in response to horizontal movement of the cantilever arm 25 when the cantilever arm 25 is impacted. In the illustrated embodiment, three pawl members 135 are provided, at mutual angles of 120 degrees to each other, and the angular arrangement of the step portions 131 is selected so that each pawl member 135 rests at a respective step height on its respective step portion 131. The number of pawl members 135 and the orientation of the pawl members 135 and the step portions 131 can be varied within the scope of the invention. A clamp member 136, helical compression spring 138 and bolt 140 are provided, having a similar structure as in the embodiment of FIG. 3. An end port 142 of the clamp member 136 bears downwardly against the upper surface 144 of the ring member 134 under the bias of the spring 138, the bias being adjustable by the bolt 140. This structure permits the ring member 134, and thereby the hopper 129, to move vertically, as described in greater detail below, in a controlled manner against the bias of the spring 138, which acts to define the limit of the vertical component of any movement of the hopper.

When the cantilever arm 125 receives impact energy from the actuator, not only does this impart a horizontal impact on the hopper 129, but also this causes the hopper 129 to jump vertically. When the hopper 129 receives impact energy in a horizontal direction from the actuator towards the hopper 129, the junction between the hopper 129/pawl members 135 remote from the actuator tends to act as a fulcrum which is vertically above the centre of gravity of the filled hopper. This causes the hopper to be rotated upwardly about that fulcrum, thereby moving the opposite side of the hopper vertically upwardly. This vertical motion tends to be associated with at least a small rotational movement about a vertical axis as well. When the hopper 129 rotates, the pawl members 135 tend progressively to be moved, in an angularly indexed manner, circumferentially around the ratchet surface 130. The provision of the ratchet surface 130 not only permanently tilts the hopper 129, but also causes rotation of the hopper 129, and consequential variation in both the angle and direction of tilt, even for only small amounts of rotational movement, particularly when a pawl member 135 suddenly drops down the height of a step portion 131 of the ratchet surface 130. The angle of maximum rotation per indexed rotational motion is controlled by the angular extent of each step portion 131. The maximum vertical movement per indexed rotational motion is controlled by the vertical height of each step portion edge 132.

FIG. 9 shows a modification of the powder dispensing apparatus of FIG. 2. In this modification, the electro-mechanical actuator 150 is oriented vertically rather than horizontally as in FIG. 2. The electromechanical actuator 150 thereby provides impact energy in a vertical direction to the cantilever arm 25, and thereby to the hopper 20.

In each of the embodiments of the invention, the controlled vertical, and optionally additional rotational motion of the hopper, coupled optionally with tilting of the hopper, assists in deagglomerating the powder particles in the hopper, which in turn enhances even and accurate powder dispensing from the hopper.

The invention claimed is:

1. A method of dispensing small quantities of particles, the method comprising the steps of: disposing in a hopper provided with a sieve at a bottom portion thereof a powder to be dispensed therefrom through the sieve; supporting the hopper by holding a portion of the hopper with a support so that the hopper is held above a container into which the dispensed powder is to be received, providing an element which is adapted to permit controlled vertical movement of the hopper relative to the support, wherein the element comprises a clamp for clamping the hopper to the support, the clamp being configured to permit the hopper to move vertically in the clamped configuration over a particular distance; and delivering impact energy to the hopper by at least one actuator thereby to cause powder to be dispensed through the sieve when the hopper receives the impact energy and to permit controlled vertical movement of the hopper relative to the support.

2. A method according to claim 1 wherein the clamp comprises a biasing device for biasing the hopper to a first position of the clamped configuration, the hopper being movable towards a second position of the clamped configuration against the bias of the biasing device.

3. A method according to claim 2 wherein the biasing device comprises a compression spring.

4. A method according to claim 3 wherein the compression spring urges the hopper downwardly.

5. A method according to claim 1 wherein the clamp comprises a stop member, spaced above a holder for the hopper, to define a height by which the holder can move vertically.

6. A method according to claim 5 wherein the height of the stop member is adjustable.

7. A method according to claim 1 wherein the element is adapted to permit controlled rotational movement of the hopper relative to the support.

8. A method according to claim 7 wherein the support comprises an annular portion having an aperture within which the hopper is received, the upper surface of the annular portion has a stepped ratchet configuration adapted to permit rotational movement of the hopper, and a holder for the hopper rests on the stepped ratchet configuration.

9. A method according to claim 8 wherein the stepped ratchet configuration comprises a succession of abutting inclined step portions extending peripherally around the upper surface of the annular portion.

10. A method according to claim 9 wherein the step portions are separated by radially directed edges.

11. A method according to any one of claims 6 to 10 wherein the holder is provided with a plurality of downwardly depending members which rest on the ratchet surface.

12. A method according to claim 11 wherein rotational movement of the hopper causes a change in the at least one of the angle and direction of tilt of the hopper.

13. An apparatus for dispensing small quantities of particles, the apparatus comprising a hopper provided with a sieve at a bottom portion thereof, the hopper defining a powder-containing zone above the sieve which in use contains powder to be dispensed therefrom through the sieve, a support for the hopper, the support holding a portion of the hopper so that the hopper can in use be held above a container into which the dispensed powder is to be received, at least one actuator for delivering impact energy to the hopper for causing powder to be dispensed through the sieve when the hopper receives the impact energy, and an element which is adapted to permit controlled vertical movement of the hopper relative to the support, wherein the element comprises a clamp for clamping the hopper to the support, the clamp being configured to permit the hopper to move vertically in the clamped configuration over a particular distance.

14. An apparatus according to claim 13 further comprising a biasing device for biasing the hopper to a first position of the clamped configuration, the hopper being movable towards a second position of the clamped configuration against the bias of the biasing device.

15. An apparatus according to claim 14 wherein the biasing device comprises a compression spring.

16. An apparatus according to claim 15 wherein the compression spring is disposed between two parts of the clamp and urges the hopper downwardly.

17. An apparatus according to claim 13 wherein the clamp comprises a stop member, spaced above a holder for the hopper, to define a height by which the holder can move vertically.

18. An apparatus according to claim 17 further comprising a height adjustment mechanism for adjusting the height of the stop member.

19. An apparatus according to any one of claims 13 to 16 wherein the support comprises an annular portion having an aperture within which the hopper is received, the upper surface of the annular portion has a stepped ratchet configuration adapted additionally to permit rotational movement of the hopper, and a holder for the hopper rests on the stepped ratchet configuration.

20. An apparatus according to claim 19 wherein the stepped ratchet configuration comprises a succession of abutting inclined step portions extending peripherally around the upper surface of the annular portion.

21. An apparatus according to claim 20 wherein the step portions are separated by radially directed edges.

22. An apparatus according to claim 21 wherein the holder is provided with a plurality of downwardly depending members which rest on the ratchet surface.

* * * * *